US006709227B2

(12) United States Patent
Quinn

(10) Patent No.: US 6,709,227 B2
(45) Date of Patent: Mar. 23, 2004

(54) PITOT TUBE INSERT

(75) Inventor: Joel Quinn, South Jordan, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 0 days.

(21) Appl. No.: 10/236,197

(22) Filed: Sep. 6, 2002

(65) Prior Publication Data

US 2003/0077165 A1 Apr. 24, 2003

(Under 37 CFR 1.47)

Related U.S. Application Data

(60) Provisional application No. 60/318,196, filed on Sep. 7, 2001.

(51) Int. Cl.[7] ..... F04D 1/12
(52) U.S. Cl. ..... 415/88; 415/121.2
(58) Field of Search ..... 415/88, 89, 121.2

(56) References Cited

U.S. PATENT DOCUMENTS

| | | | | |
|---|---|---|---|---|
| 3,093,080 A | | 6/1963 | Tarifa et al. | |
| 3,374,747 A | | 3/1968 | King et al. | |
| 3,384,023 A | | 5/1968 | King et al. | |
| 3,776,658 A | | 12/1973 | Erickson | |
| 3,822,102 A | | 7/1974 | Erickson et al. | |
| 3,999,881 A | | 12/1976 | Crichlow | |
| 4,183,713 A | | 1/1980 | Erickson et al. | |
| 4,252,499 A | | 2/1981 | Erickson | |
| 4,264,269 A | | 4/1981 | Erickson et al. | |
| 4,267,964 A | | 5/1981 | Williams | |
| 4,279,571 A | | 7/1981 | Erickson | |
| 4,674,950 A | | 6/1987 | Erickson | |
| 4,784,630 A | * | 11/1988 | Takahashi | 474/28 |
| 5,525,034 A | | 6/1996 | Hays | |
| 5,997,243 A | | 12/1999 | Shaw | |

FOREIGN PATENT DOCUMENTS

| | | |
|---|---|---|
| SU | 901633 | 1/1982 |
| SU | 1399507 | 5/1988 |
| SU | 1513205 | 10/1989 |

* cited by examiner

*Primary Examiner*—Ninh H. Nguyen
(74) *Attorney, Agent, or Firm*—Morriss O'Bryant Compagni, P.C.

(57) ABSTRACT

A pitot tube inlet for the pitot tube of a centrifugal pump is configured to improve pump efficiencies when processing fluids that have a solids content the type or character of which causes the solids to accumulate along the inner peripheral surface of the rotor of the pump. The pitot tube inlet is configured to contact and remove the accumulated solids from the rotor to lessen the drag on the rotor, to lessen degradation of the pitot tube and to improve pump efficiencies.

11 Claims, 3 Drawing Sheets

PITOT TUBE INSERT

CROSS-REFERENCE TO RELATED APPLICATION

This application is a non-provisional application claiming priority to provisional application Ser. No. 60/318,196 filed Sep. 7, 2001.

BACKGROUND

1. Field of the Invention

This invention relates to centrifugal pumps of the pitot tube type, and specifically relates to a modified inlet opening of a pitot tube for contacting and removing accumulated solids from the pump rotor.

2. Description of Related Art

Centrifugal pumps of the pitot tube type are well-known in the pumping industry as being useful in low flow/high pressure applications. Centrifugal pumps of the pitot tube type are generally structured with a closed rotor which is housed within the casing of the pump. A pitot tube assembly is positioned through a central opening of the rotor and is secured to the pump casing. A pitot tube arm of the pitot tube assembly is positioned within the rotor and is radially-oriented relative to the axis of the pump. The pitot tube arm is stationary while the rotor rotates about the pitot tube arm.

In operation, fluid enters into the rotor along the axis of rotation through radially-oriented fluid channels formed in the rotor cover. The fluid enters the internal space of the rotor where it picks up momentum and is subjected to centrifugal forces as the rotor spins. The fluid maintains its velocity at nearly the rotational speed of the rotor.

The pitot tube arm is structured with an inlet to receive fluid, and the inlet opening of the pitot tube is positioned near the inner periphery, or internal diameter, of the rotor. As the fluid is directed to the periphery of the rotor the fluid moves into the inlet of the pitot tube, through an inner channel of the pitot tube and out of the pump by way of a discharge outlet.

Traditionally, pitot tubes have been cast and machined with the inlet opening formed or configured as it will be used in the pump. However, after continued use of the pump, particularly when abrasive fluids are being processed by the pump, the impact of the fluid on the opening of the pitot tube causes degradation of the inlet and eventually pump efficiencies are adversely affected. The pitot tube arm must then be replaced in its entirety, which is very costly and increases operation costs.

The development of an insert for a pitot tube and the advantages of such inserts was first described in U.S. Pat. No. 5,997,243 to Shaw, issued Dec. 7, 1999 and assigned to the same assignee as the present application. U.S. Pat. No. 5,997,243 is incorporated herein by reference. The '243 patent discloses a pitot tube inlet insert which allows the inlet opening of a pitot tube to be replaced after it has been degraded or damaged with use. The inlet insert eliminates the need to replace the entire pitot tube arm thereby reducing operating costs. The pitot tube insert described in the '243 patent improves the efficiency of the pump and reduces or eliminates cavitation and degradation of the pitot tube inlet.

An additional problem occurs in pitot tube pumps which has not been previously addressed. That is, when the fluid being pumped contains particulate matter or solids, the impact of the fluid and solids on the pitot tube can be very damaging, with a resulting loss in head. Additionally, when solids are present in the fluid, the solids are thrown against the inside peripheral surface of the rotor under centrifugal force and can build up on the rotor. The accumulated solids built up on the interior peripheral surface of the rotating rotor then impact with the stationary pitot tube as the rotor spins and can cause an increase in drag on the rotor. Consequently, pump efficiency is sacrificed. The impact of the inlet against the solids further contributes to the degradation of the inlet and pitot tube arm.

Thus, it would be advantageous in the art to provide a pitot tube inlet which is designed to provide improved pump efficiencies when the pitot tube pump is used to process liquids containing solids that can build up on the rotor, and it would be advantageous to provide a pitot tube inlet insert which is designed to provide improved pump efficiencies under such conditions while also providing the advantage of being easily replaced at a relatively low cost.

BRIEF SUMMARY OF THE INVENTION

In accordance with the present invention, a pitot tube inlet is configured to contact and remove the solids that build up on the inside peripheral surface of the rotor of a centrifugal pump to thereby improve the operational efficiency of the pump. While the present invention is principally described herein with respect to providing a pitot tube inlet insert that is configured for removing solids from the inside peripheral surface of the rotor, the design and configuration characteristics of the invention are equally applicable to a pitot tube which is unitarily cast in the traditional mode.

The pitot tube inlet of the present invention generally comprises an opening, which is positioned and sized to receive fluid from the peripheral portion of the rotor of a pitot tube pump, and a lip portion surrounding at least a part of the circumference or perimeter of the opening such that the lip portion is positioned to contact and remove solids that tend to accumulate and adhere to the inner peripheral surface of the rotor. The lip portion of the pitot tube inlet is generally directed away from the opening to provide a scoop-like portion which is capable of excising solids from the inner peripheral surface of the rotor.

The lip portion of the pitot tube inlet is also configured with a curved inner surface oriented about the opening of the inlet to direct solids into the opening of the pitot tube for discharge. The curvature of the inner surface not only facilitates directing the solids into the pitot tube, but increases the longevity of the pitot tube inlet by efficiently deflecting solids and liquid in a manner which decreases the usual degradation experienced in pitot tube inlets. The size, shape, dimension, angle, extension and/or circumferential extent of the lip portion may vary as long as the lip portion is capable of contacting and removing accumulated solids from the inner peripheral surface of the rotor to reduce or eliminate drag on the rotor to improve the operational efficiency of the pump.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
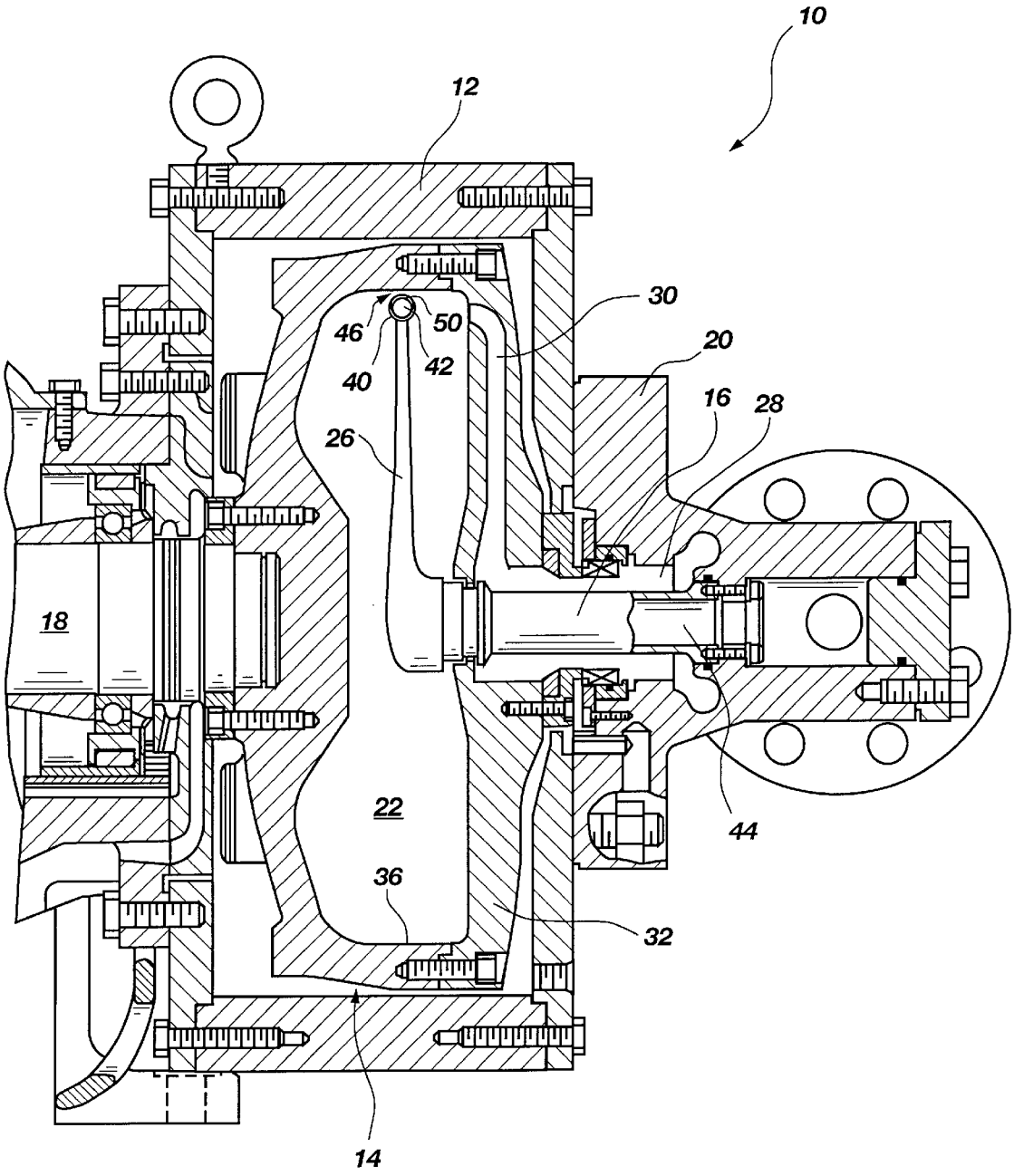
FIG. 1 is a view in cross section of a portion of a centrifugal pump of the pitot tube type which illustrates the pitot tube inlet of the present invention positioned within the pump.

FIG. 1 illustrates a centrifugal pump of the pitot tube type 10 which generally comprises a pump casing 12 that houses a rotor 14 and a pitot tube assembly 16. The rotor 14 is caused to rotate within the pump casing 12 by a drive means 18 while the pitot tube assembly 16 remains stationary by virtue of its securement to the pump casing 12, or more specifically, as shown here, a manifold 20. The rotor 14, which may be said to be bowl-shaped, has an internal space 22 in which is positioned a pitot tube arm 26 of the pitot tube assembly 16. Fluid enters the pump 10 through an inlet (not shown) that directs the fluid to an annular space 28 surrounding the pitot tube assembly 16. Fluid moves from the annular space 28 through radially-oriented channels 30 formed in the cover 32 of the rotor, and then enters the internal space 22 of the rotor 14.

As the rotor 14 spins, the velocity of the fluid in the internal space 22 increases and centrifugal forces act on the fluid to move it to the inner peripheral surface 36 of the rotor 14. There the fluid is intercepted by an inlet 40 that is formed at the outer or radial extremity of the pitot tube arm 26. The fluid enters into the opening 42 of the inlet 40 and flows through a channel (not shown) internally formed in the pitot tube arm 26. The fluid then enters the pitot tube assembly 16 and flows in an axial direction through a discharge channel 44 defined by a bore formed within the pitot tube assembly 16.

It can be seen from FIG. 1 that the pitot tube arm 26 is sized in length to extend to near the inner peripheral surface 36 of the rotor 14 such that a very small gap 46 exists between the inlet 40 of the pitot tube arm 26 and the inner peripheral surface 36 of the rotor 14. The opening 42 of the pitot tube arm 26 provides a means for entry of fluid into the pitot tube arm 26, but some of the fluid that is encountered by the inlet 40 merely strikes the inlet 40 or edge of the opening 42 at high velocity and pressure. The damage that results has been previously described in the literature.

When fluids containing solids or particulate matter are processed in pitot tube pumps 10, there is a tendency for the solids or particular matter to accumulate and build up on the inner peripheral surface 36 of the rotor 14 since the solids material or particular matter is, itself, forced radially outwardly as the rotor 14 spins. It can be seen, therefore, that given the small gap 46 between the inlet 40 of the pitot tube arm 26 and the inner peripheral surface 36 of the rotor 14, the inlet 40 will impact with the accumulated solids layer and drag on the rotor 14 will increase with a corresponding increase in horsepower required to maintain rotational speed. The impact of the inlet 40 on the solids layer will also act to degrade the inlet 40 of the pitot tube arm 26. The pump efficiency is adversely effected as a result.

The present invention addresses that concern by providing a pitot tube inlet 40 which is configured to contact and remove the accumulated solids so that the rotor 14 may rotate freely and not adversely effect the operating efficiency of the pump. The pitot tube inlet 40 is especially designed to withstand the otherwise destructive action of impact with the solids layer. Accordingly, the pitot tube inlet 40 of the present invention comprises an opening 42 the surrounding perimeter edge of which is shaped, at least in part, with a lip portion 50 that is positioned and oriented to contact the solids layer at the inner peripheral surface 36 of the rotor 14.

The pitot tube inlet 40 of the present invention is shown more clearly in FIGS. 2–7 which illustrate the invention as an insert 52 that is particularly designed for attachment to the formed inlet of a pitot tube arm 26 (FIG. 1) and that can be replaced when damaged with wear. However, it is understood that the pitot tube inlet 40 of the present invention may also be formed as an integral part of the pitot tube arm 26, as shown in FIG. 1, when the pitot tube arm is cast as a single body.

Figure 2:
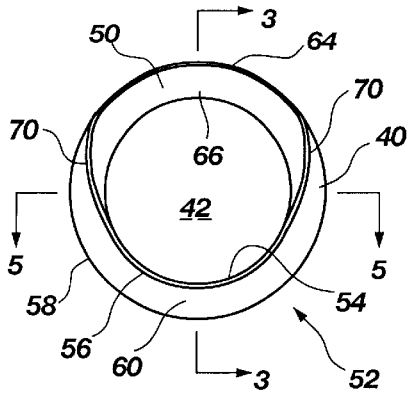
FIG. 2 is a front view of a first embodiment of the pitot tube inlet of the present invention, shown as an insert and looking into the opening of the inlet.
Figure 3:
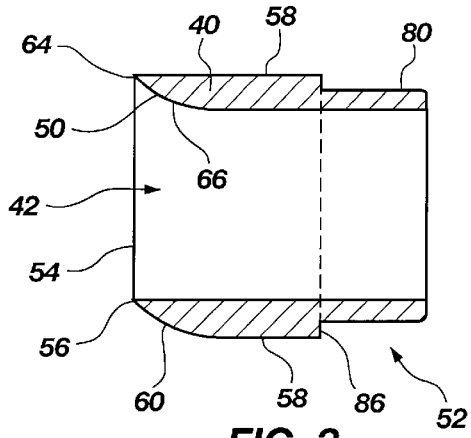
FIG. 3 is an enlarged view in cross section of the pitot tube inlet shown in FIG. 2, taken at line 3—3.
Figure 4:
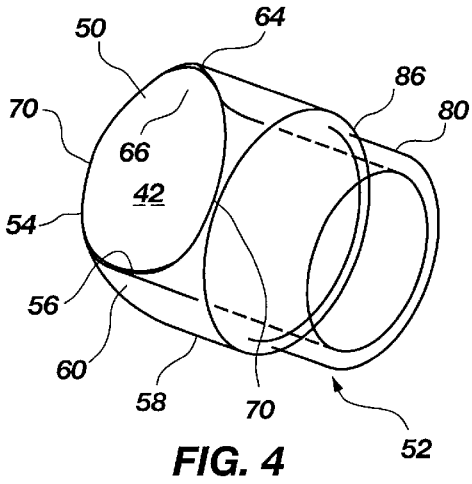
FIG. 4 is a perspective view of the pitot tube inlet insert shown in FIG. 2.
Figure 5:
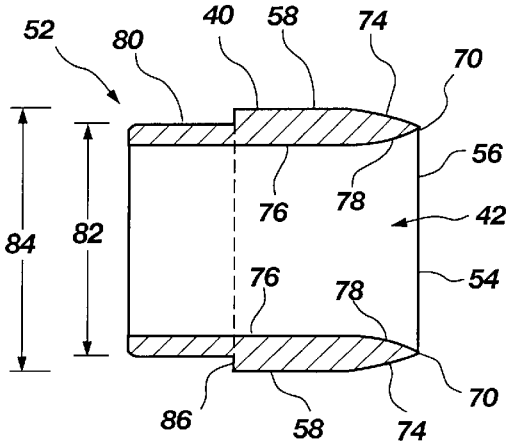
FIG. 5 is a view in cross section of the pitot tube inlet insert shown in FIG. 2 taken at line 5—5.

FIG. 2 illustrates the pitot tube inlet 40 from a view looking into the opening 42 thereof. The opening 42 of the inlet 40 is surrounded by a perimeter edge 54 which defines the opening 42 of the inlet 40. A first portion 56 of the perimeter edge 54 of the opening 42 is spaced inwardly from the circumferential wall 58 of the inlet 40 to form a sloped shoulder 60. The sloped shoulder 60 is positioned away and at a distance from the inner peripheral surface 36 of the rotor 14. However, the sloped shoulder 60 is positioned to contact the high velocity fluid in the rotor and is especially designed to help direct fluid into the opening 42 and deflect that fluid which does not enter the opening 42 away from the inlet 40 to reduce damage to the inlet 40. The particular angle and/or curvature of the sloped shoulder 60 may be modified to accommodate a particular fluid application.

A second portion 64 of the perimeter edge 54 of the opening 42 is oriented outwardly from the center of the opening 42 such that it flares or extends away from the opening 42 and from the lower portion 56 of the perimeter edge 54 to provide a lip portion 50. The lip portion 50 is positioned in the pump to be located in near proximity and orientation to the inner peripheral surface 36 of the rotor 14. The second portion 64 of the perimeter edge 54 contacts the solids which accumulate on the inner peripheral surface 36 of the rotor 14 and the lip portion 50 effectively scoops out the solids that have built up.

The lip portion 50 further comprises an inner sloping surface 66 which is configured to direct the removed or captured solids into the opening 42 of the inlet 40 from where the solids are transported through the pitot tube assembly for discharge. The inner sloping surface 66 has a curvature which not only facilitates directing solids into the opening 42, but facilitates deflection of solids and liquid in a manner which reduces the damaging effects that fluid and solids typically have on pitot tube inlets. Consequently, the longevity of the pitot tube inlet 40 (and insert 52) is enhanced.

There is a transition zone 70 of the perimeter edge 54 where the inwardly oriented first portion 56 of the perimeter edge 54 transitions to the outwardly oriented second portion 64 of the perimeter edge 54. The cross section view of FIG. 5 further illustrates that in the transition zone 70 of the perimeter edge 54, the circumferential wall 58 of the inlet 40 becomes less curved, as compared with the sloped shoulder 60 of the inlet 40, to provide a transition shoulder 74, and the inner surface 76 of the inlet 40 also transitions to curve outwardly toward the perimeter edge 54 to provide a transitional inner sloping surface 78. The configurational elements which comprise the first embodiment of the invention are further viewable in the computer-generated three-dimensional models of FIGS. 6 and 7.

Again, as illustrated in FIGS. 2–7, the pitot tube inlet 40 of the present invention is illustrated as an insert 52 that may be attached to a pitot tube arm that has been cast and/or machined with an opening to receive the insert 52. To allow the insert 52 to be received in the pitot tube arm, the insert 52 is further formed with a neck portion 80 the outer diameter 82 (FIGS. 3 and 5) of which is less than the outer diameter 84 of the circumferential wall 58 of the inlet 40. A ledge 86 is thus formed which abuts against an edge surrounding the cast or machined opening formed in the pitot tube arm.

The lip portion 50 of the inlet 40 is configured to not only scoop out solids that have accumulated on the inner peripheral surface of the rotor, but is also configured to direct free-moving solids into the opening 42 of the inlet 40 so that those solids may be removed as well. Further, the sloped shoulder 60 of the inlet 40 is configured and dimensioned to provide an aerodynamic surface against which fluid flows, thereby improving pump efficiencies. While the lip portion 50 of the inlet 40, by virtue of its flared configuration and inner sloping surface 66, produces some drag on the fluid and solids moving in the inner periphery of the rotor which can tend to reduce pump efficiency, it has been demonstrated that what may be lost in some pump efficiency caused by the drag is overcome by the increased efficiencies and improved longevity of the pitot tube derived from addressing the accumulated solids problem.

Figure 8:
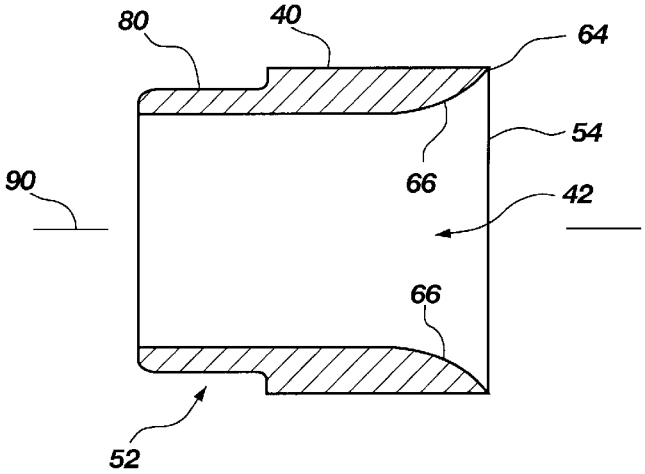
FIG. 8 is another alternative embodiment of the present invention.
Figure 6:
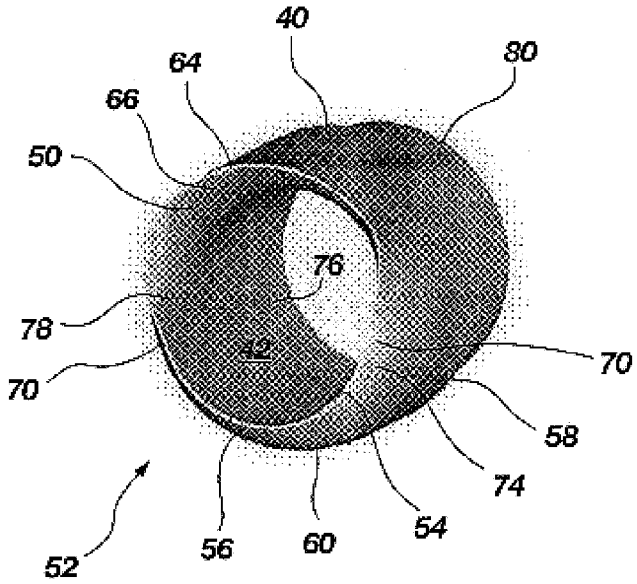
FIG. 6 is a computer-generated three-dimensional model of the pitot tube inlet insert shown in FIGS. 2–5 illustrating a view of the inlet opening.
Figure 7:
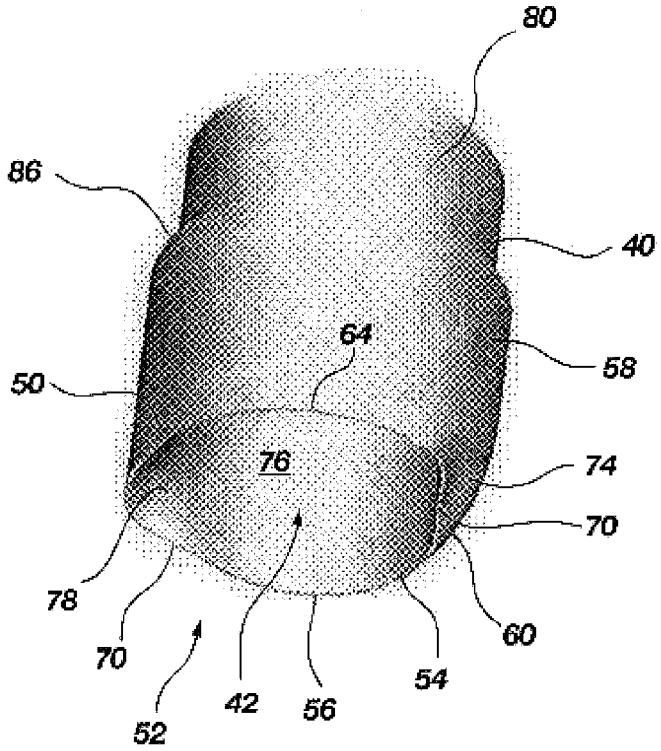
FIG. 7 is a computer-generated three-dimensional model of the pitot tube inlet insert shown in FIG. 6 tilted downwardly approximately forty-five degrees.

The first embodiment of the invention shown in FIGS. 1–7 illustrates an inlet 40 having a lip portion 50 which extends approximately 180° about the circumference of the opening 42, which is defined by the perimeter edge 54. However, as shown in the alternative embodiment illustrated in FIG. 8, the lip portion 50 may extend 360° about the opening 42 of the inlet 40 thereby providing a scooping capability about the entire circumference of the opening 42. FIG. 8 is a longitudinal cross section through the inlet 40 of the alternative embodiment and the view would be identical regardless of where the cross section was taken through the longitudinal axis 90 of the inlet 40.

The lip portion 50 of the pitot tube inlet 40, particularly facilitated by the inner sloping surface 66, is effective at directing solids and fluids into the opening 42 of the inlet 40 and scooping out built-up solids at the periphery of the rotor. However, the 360° extent of the lip portion 50 presents some increase in drag on the fluid and may reduce efficiencies accordingly. In applications where fluids of high solids content are being processed, a pitot tube inlet 40 having a 360° lip portion 50 may, nonetheless, be especially advantageous and provide increased pump efficiencies as compared with prior art pitot tube inlets having no lip portion. The lip portion 50 of the inlet 40 of the present invention may encircle or extend anywhere from about 5° to 360° about the circumference of the opening 42 of the inlet 40.

The inlet 40 of the present invention has been described and illustrated as having a substantially round opening 42 defined by the perimeter edge 54 and a substantially round outer circumference defined by the circumferential wall 58. However, the shape and dimension of the inlet 40 and its opening 42 need not be round. Indeed, the inlet 40 and/or opening 42 may be any suitable shape which is appropriate to the application for which it is being used. By way of example only, the inlet 40 and opening 42 may be ovoid in shape.

The inlet 40 of the present invention may be made by casting in a mold by known methods, whether the inlet 40 is integrally formed as part of the pitot tube arm or is formed in the manner of an insert. Alternatively, and particularly with respect to the embodiment of the invention comprising a 360° lip portion 50, the inlet 40 may be made by machining from stock by methods that are known in the art. The inlet may be made from any suitable material which has increased erosion-resistant character such as tungsten carbide, by way of example only. Numerous other materials are equally suitable.

The pitot tube inlet is configured to provide increased pump efficiencies when processing fluids that contain solids, particularly when the solids are of a type or concentration which causes the solids to accumulate along the inner peripheral surface of the rotor of the pump. The pitot tube inlet of the present invention is modifiable in shape and dimension to adapt to any application. Therefore, reference herein to specific details of the structure and function of the present invention is by reference only and not by way of limitation.

What is claimed is:

1. A pitot tube for a centrifugal pump, comprising:

a pitot tube arm for positioning in radial orientation within the rotor of a centrifugal pump; and an inlet formed in said arm and positioned to receive fluid from the inner peripheral surface of the rotor of the pump, said inlet further comprising a lip portion positioned and configured to contact and remove accumulated solids from the inner peripheral surface of the rotor and to direct the solids into said inlet for discharge from the pump.

2. The pitot tube of claim 1 wherein said inlet further comprises an opening defined by a perimeter edge and said lip portion extends about said opening from about 5° to 360° of the circumference of said opening.

3. The pitot tube of claim 2 wherein said lip portion of said inlet is configured with an inner sloping surface to direct solids into said opening of said inlet.

4. The pitot tube of claim 1 wherein said inlet further comprises a circumferential wall and an opening defined by a perimeter edge a first portion of which extends inwardly from said circumferential wall to provide a sloped shoulder and a second portion of which extends outwardly relative to said first portion of said perimeter edge to provide said lip portion.

5. The pitot tube of claim 4 wherein said lip portion extends about said opening of said inlet from about 5° to about 350° of the circumference of said opening.

6. A pitot tube inlet insert, comprising:

a three-dimensional body having a circumferential wall and a neck portion sized for receipt into the opening of an inlet of a pitot tube;

an opening positioned opposite said neck portion, said opening being defined by a perimeter edge; and a lip portion formed about at least a portion of said opening, said lip portion being configured to contact and remove accumulated solids from the inner peripheral surface of the rotor of a centrifugal pump and to direct the solids into said opening for discharge from the pump.

7. The pitot tube inlet insert of claim 6 wherein said lip portion of said inlet is configured with an inner sloping surface to direct solids into said opening of said inlet.

8. The pitot tube inlet insert of claim 6 wherein said lip portion extends about said opening from about 5° to 360° of the circumference of said opening.

9. The pitot tube inlet insert of claim 6 wherein said perimeter edge further comprises a first portion which extends inwardly from said circumferential wall of said pitot tube inlet insert to provide a sloped shoulder and a second portion which extends outwardly relative to said first portion of said perimeter edge to provide said lip portion.

10. The pitot tube inlet insert of claim 9 wherein said lip portion extends about said opening from about 5° to about 350° of the circumference of said opening.

11. The pitot tube inlet insert of claim 10 wherein said lip portion further comprises an inner sloping surface configured to direct solids into said opening.

* * * * *